US007648183B2

(12) United States Patent
Cornwell

(10) Patent No.: US 7,648,183 B2
(45) Date of Patent: Jan. 19, 2010

(54) LATCHING APPARATUS AND METHOD

(76) Inventor: Carl R. Cornwell, 159 Crain Rd., Columbia, LA (US) 71418

( * ) Notice: Subject to any disclaimer, the term of this patent is extended or adjusted under 35 U.S.C. 154(b) by 612 days.

(21) Appl. No.: 11/386,185

(22) Filed: Mar. 22, 2006

(65) Prior Publication Data

US 2007/0222244 A1 Sep. 27, 2007

(51) Int. Cl.
*B66C 1/62* (2006.01)

(52) U.S. Cl. ..... 294/90

(58) Field of Classification Search ..... 294/89, 294/90; 279/89; 901/31
See application file for complete search history.

(56) References Cited

U.S. PATENT DOCUMENTS

| | | | | |
|---|---|---|---|---|
| 743,543 | A | | 11/1903 | Munn |
| 1,082,786 | A | * | 12/1913 | Yungling ..... 294/91 |
| 2,161,501 | A | | 1/1939 | Blackmon |
| 2,796,284 | A | | 6/1957 | Benson et al. |
| 3,043,614 | A | | 7/1962 | Eichmann |
| 3,161,930 | A | | 12/1964 | Crosson |
| 3,445,133 | A | | 5/1969 | Reischl |
| 3,551,964 | A | | 1/1971 | Shaw |
| 3,661,416 | A | | 5/1972 | Bukarkin et al. |
| 3,666,216 | A | | 5/1972 | Nagy et al. |
| 3,795,420 | A | | 3/1974 | Preston, Jr. |
| 3,845,963 | A | * | 11/1974 | Price ..... 279/89 |
| 4,359,960 | A | | 11/1982 | Burchett et al. |
| 4,360,230 | A | | 11/1982 | Wood et al. |
| 4,361,353 | A | * | 11/1982 | Vinson ..... 294/86.1 |
| 4,405,263 | A | | 9/1983 | Hall |
| 4,585,369 | A | | 4/1986 | Manesse et al. |
| 4,597,689 | A | | 7/1986 | Mitchell et al. |
| 4,644,617 | A | | 2/1987 | Tupper et al. |
| 4,684,285 | A | | 8/1987 | Cable |
| 4,708,524 | A | | 11/1987 | Goris |
| 4,978,244 | A | | 12/1990 | Lange |
| 5,088,853 | A | | 2/1992 | Reid |
| 5,816,732 | A | | 10/1998 | Nissen |
| 6,935,805 | B2 | | 8/2005 | O'Brien et al. |
| 2004/0001738 | A1 | | 1/2004 | Schipani et al. |

* cited by examiner

*Primary Examiner*—Paul T Chin
(74) *Attorney, Agent, or Firm*—Jones Walker

(57) ABSTRACT

A latching apparatus for lifting and lowering loads. The apparatus comprises a prong and a receiving receptacle configured to receive the prong. The receiving receptacle comprises a body having a central passage, a plurality of jaws arranged about the central passage, and a spring for biasing the jaws to extend into the central passage. The latching apparatus may further comprise an activation disc for disengaging the jaws from the prong. The jaws have a pin extending therefrom; and wherein the activation disc contains a plurality of cam surfaces that engage the pin of the jaws. A method of latching onto a container is also disclosed.

10 Claims, 7 Drawing Sheets

LATCHING APPARATUS AND METHOD

BACKGROUND OF THE INVENTION

This application relates to a latching mechanism. More specifically, but not by way of limitation, this invention relates to a latching mechanism for lifting and lowering containers.

In industrial applications, operators find it necessary to lift containers. Many times, the containers are located in remote areas. For instance, in the offshore energy industry, boats ferry equipment to platforms located many miles from shore. As those of ordinary skill in the art will recognize, the seas can get quite rough. Generally, the containers will be positioned on the aft deck of the boat. In order to offload the equipment, a platform crane is used to lift the containers from the boat deck onto the platform.

Prior art devices requires the use of a ball hook, which is attached to the cable. A deck hand is required to attached the ball hook onto the containers. Sometimes, the ball hook is attached to a set of slings. As those of ordinary skill in the art will recognize, attaching the ball hook onto the slings is a dangerous endeavor since the boat may be rocking due to wind and/or waves. For instance, in 10 foot seas, the boat may be traveling vertically as much as 20 feet since the boat will ride the crest of the wave to the trough of the wave. However, the ball hook is not moving in unison with the boat since the crane is mounted on the platform. Additionally, in some applications, the crane may be mounted on floating platform. Therefore, the potential for injury to the deck hand is high due to the logistics of rigging up and rigging down the ball hook to the container.

Therefore, there is a need to have an apparatus and mechanism that allows quick and safe latching and unlatching onto containers. There is also a need that will allow for the lifting containers. There is also a need for a device and method that allows for containers on vessels to be safely loaded and/or offloaded. These needs, and many others, will be met by a reading of the following detailed description of the preferred embodiments.

SUMMARY OF THE INVENTION

A latching apparatus for lifting and lowering loads is disclosed. In the preferred embodiment, the apparatus comprises a prong having a protuberance at a first end and a receiving receptacle configured to receive the first end of the prong. In one preferred embodiment, the receiving receptacle comprises a body having a central passage, a plurality of jaws arranged about the central passage, and biasing means for biasing the jaws to extend into the central passage and engaging the protuberance. The biasing means may comprise a spring having a first end engaging the jaws and a second end engaging an internal portion of the body so that the jaws are biased toward the central passage.

The latching apparatus may further comprise an activation disc for disengaging the jaws from the protuberance. In one preferred embodiment, the jaws have a pin extending therefrom; and wherein the activation disc contains a plurality of cam surfaces that engage the pin of the jaws. Additionally, the body may comprise a first section that is attached to a second section, and wherein the second section contains the jaws and the activation disc, and wherein the first section is configured to abut and align the plurality of jaws.

The latching apparatus may further comprise a handle mounted through the body so that the handle has an exterior portion and an internal portion, and wherein the handle has a projection that engages the activation disc so that movement of handle creates movement of the activation disc. The latching apparatus may further comprise an alignment skirt attached to the body, and wherein the alignment skirt has a conical shape, and wherein the alignment skirt is configured to direct the prong into the central passage.

In one embodiment, the spring is disposed about an indicator pin, and the indicator pin extends through an aperture in the body when the jaw inserts are disengaged from the protuberance. Also, the latching mechanism may further comprise a jaw insertion device for engaging the jaw inserts from the aperture within the body.

A method of latching onto a container is also disclosed. The method includes providing a prong having a protuberance at a first end, and wherein the prong is attached to the container, and wherein the protuberance has a neck portion formed thereon. The method further comprises providing a receiving receptacle configured to receive the first end of the prong, the receiving receptacle comprising: a body having a central passage; a plurality of jaws arranged about the central passage; and, a spring having a first end engaging the jaws and a second end engaging an internal portion of the body so that the jaws are biased into the central passage. The method further includes lowering the receiving receptacle so that the protuberance enters the central passage, engaging the protuberance with the jaws, and compressing the spring. The method further includes opening the jaws while continuing to lower the receiving receptacle, allowing the jaws to close about the neck portion, and latching the protuberance with the jaws.

In one preferred embodiment, the receiving receptacle has attached a cable, and the method further comprises pulling on the cable to lift the container. Also, in one preferred embodiment, the receiving receptacle further comprises an activation disc for disengaging the jaws from the protuberance, and wherein the method further comprises turning a handle which rotates a projection on the handle and engaging the projection with the activation disc so that rotation of the projection causes rotation of the activation disc. Next, the activation disc is rotated and the pin on the jaws is engaged with a cam surface on the activation disc via the rotation of the activation disc. Next, the spring is compressed, and the jaws are expanded and released from the protuberance, thereby unlatching the receiving receptacle from the prong.

Additionally, in one preferred embodiment, the prong has a cylindrical body and the first end of the jaws is curved, and wherein the step of latching the protuberance with the jaws includes engaging the curved end of the jaws about the cylindrical body of the prong. Also, a funnel may extend from the body, and wherein the step of lowering the receiving receptacle includes guiding the jaws onto the prong with the funnel.

An advantage of the present invention is the ability to connect and disconnect quickly and safely. Another advantage is that the present apparatus can offload equipment from floating vessels. Still yet another advantage is that the receptacle can be latched onto the prong without the need to have a person directly operating the latch. In other words, the apparatus can be lowered from a platform on a cable, and the prong can be attached to a container on a boat deck, and due to the design, the receptacle can be latched onto the prong by having the crane operator lower the skirt onto the prong without having an individual on the deck of the boat. Still yet another advantage is the ability to remotely control the handle means in order to turn the handle A feature of the present invention is a fishing neck type of prong that is configured to engage with the jaw mechanism. A feature of the jaw mechanism is the multiple inserts that are used to engage with the prong. Another feature is the jaw mechanism is a spring loaded latch mechanism which allows entry of the prong, and thereafter, captures the prong. Yet another feature is the disc activation device that is used to unlatch the apparatus from the prong. Still yet another feature is the skirt that serves to funnel the prong into the jaw mechanism.

DETAILED DESCRIPTION OF THE PREFERRED EMBODIMENTS

Figure 1:
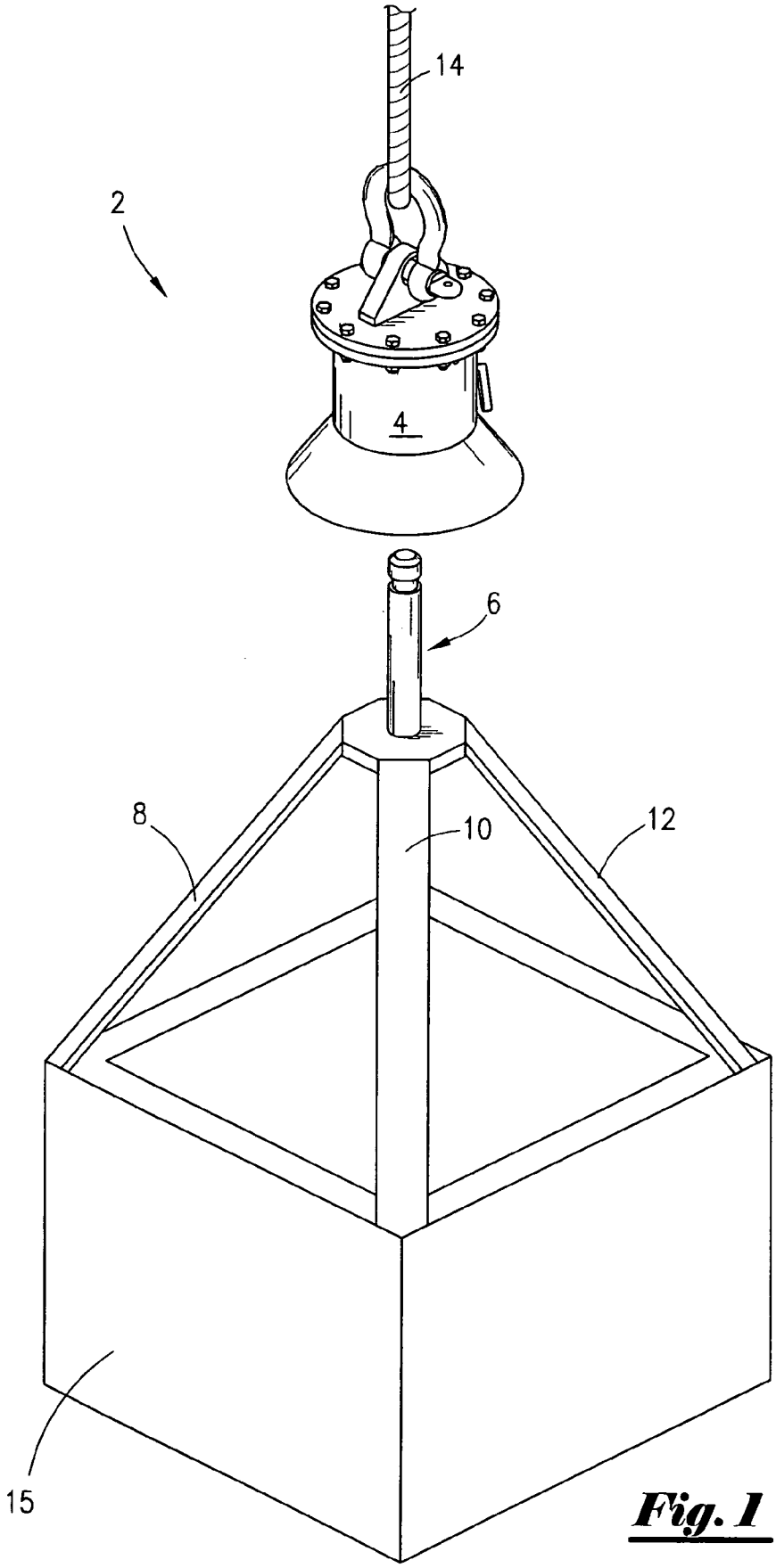
FIG. 1 is a perspective view of the latching mechanism as the receiving receptacle is being lowered.

FIG. 1 illustrates a perspective view of the most preferred embodiment of the latching mechanism 2 that includes the receiving receptacle 4 and the prong 6. FIG. 1 further illustrates the support members 8, 10, 12 that will be connected to a container 15. The receiving receptacle 4 is being lowered via cable 14 that is connected to a shackle.

Figure 2:
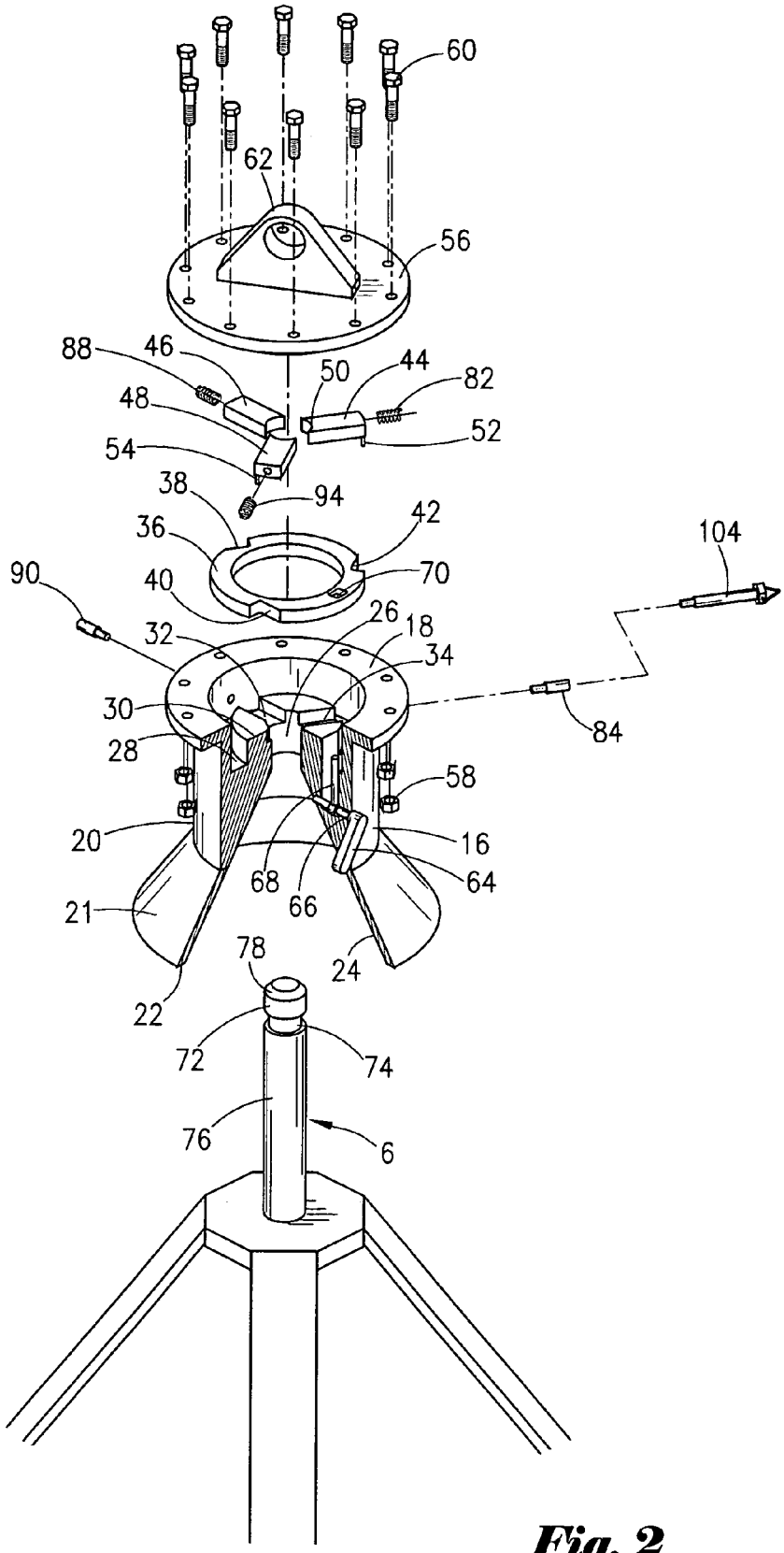
FIG. 2 is an exploded view of the most preferred embodiment latching mechanism that includes the receiving receptacle and the prong.

Referring now to FIG. 2, an exploded view of the most preferred embodiment of the latching mechanism 2 will now be described. FIG. 2 depicts the body 16, wherein the body includes a flange end 18 that extends to a cylindrical body 20 that in turn extends to the conically shaped outer surface 21 which in turn terminates at the radial end 22. Extending radially inward is the conically shaped inner surface 24, and wherein the conically shaped inner surface 24 may be referred to as the funnel 24. The funnel 24 extends to the central bore passage 26.

As seen in FIG. 2, the flanged end 18 extends radially inward to a groove section 28. The groove section 28 is configured to have a cylindrical inner wall 30, and wherein three radial grooves are formed therein (only radial grooves 32, 34 are shown in FIG. 2). An activation disc 36 is shown, and wherein the activation disc 36 contains the cam surfaces 38, 40, 42. The activation disc 36 is configured to be positioned within the groove section 28. FIG. 2 further depicts the jaw inserts 44, 46, 48, wherein the jaws 44, 46, 48 are configured to be positioned within the radial grooves (i.e. radial grooves 32, 34). The jaws 44, 46, 48 have a first end that has a curved portion such as seen at 50. The jaws 44, 46, 48 also contain a pin on the underside, such as pins 52, 54, and wherein the pins will engage the cam surfaces 36, 38, 40 of the activation disc 36 as will be more fully described.

FIG. 2 also depicts the cover plate 56 to cooperate and engage with the body 16, and more specifically, the flange end 18. As seen in FIG. 2, nuts and bolts (such as nut 58 and bolt 60) are used to attach the cover plate 56 to the body 16. It should be noted that the cover plate 56 is configured to abut and align the top side of the plurality of jaws and activation disc. FIG. 2 also shows the eyelet plate 62 that can be used to attach to a cable via a shackle, as well understood by those of ordinary skill in the art. FIG. 2 also depicts the handle 64 that is disposed through the body 16. The handle 64 has a radially extending arm 66, and wherein a projection 68 extends perpendicularly from the arm 66. The projection 68 will fit through the opening 70 that is disposed through the activation disc 36. Hence, the lateral movement of the projection 68 (by virtue of the handle 64 being turned) will in turn cause the activation disc 36 to rotate, as will be more fully explained later in the application.

The prong 6 is also shown in FIG. 2. More specifically, the prong 6 is generally a cylindrical member that contains a protuberance 72 that extends to a neck portion 74, and wherein the neck portion 74 is a reduced diameter groove about the stem 76. The protuberance 72 contains the chamfered surface 78. The jaws 44, 46, 48 will cooperate and engage with the neck portion 74 in order to latch the receiving receptacle with the prong 6. FIG. 2 depicts the spring 82 that will be disposed about indicator pin 84; spring 88 that will be disposed about indicator pin 90; and, spring 94 that will be disposed about an indicator pin (not shown in this view), as will be more fully set out below.

This embodiment also depicts the jaw insertion device 104. In the event that the jaws 44, 46, 48 become stuck, it is within the teachings of this invention that the indicator pins 84, 90, 96, operatively associated with each jaw, be removed. In order to remove the indicator pins 84, 90, 96, the operator could simply unscrew the indicator pins from the jaws. After the indicator pins 84, 90, 96 are removed, the jaw insertion device 104 is threaded into the respective jaw. In the most preferred embodiment, the jaw insertion device 104 has an external threaded end that will engage an internal thread means within the jaw. Hence, after engaging the jaw insertion device 104, the operator can exert a pull force on the device 104 which would in turn move the jaw 44 thereby unsticking and/or dislodging the jaw.

Figure 3:
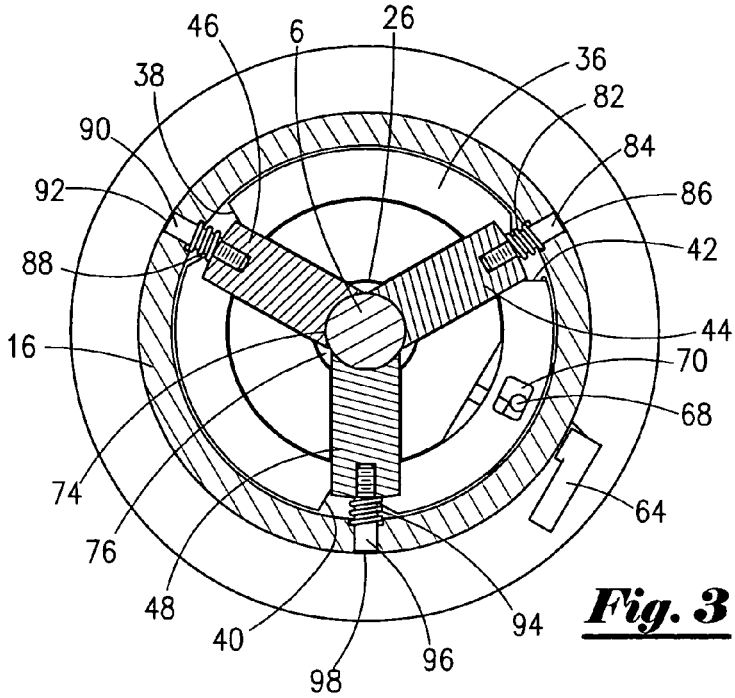
FIG. 3 is a partial cross-sectional view of the jaws and activation disc of the most preferred embodiment.

Referring now to FIG. 3, a partial cross-sectional view of the jaws 44, 46, 48 and activation disc 36 of the most preferred embodiment will now be described. In the view of FIG. 3, the cover plate 56 has been removed. FIG. 3 depicts the spring 82 that is disposed about the indicator pin 84, and wherein indicator pin 84 has a first end within the aperture 86 and a second end threadedly engaged within the jaw 44. As shown in FIG. 3, the spring 82 biases the jaw 44 toward the axial center i.e. against the neck portion 74 of the prong 6.

FIG. 3 also depicts the spring 88 that is disposed about the indicator pin 90, and wherein pin 90 has a first end disposed within the aperture 92 and a second end threadedly engaged within the jaw 46, wherein the spring 88 biases the jaw 46 toward the axial center i.e. against the neck portion 74 of the prong 6. The spring 94 that is disposed about the indicator pin 96, and wherein indicator pin 96 has a first end within the aperture 98 and a second end threadedly engaged within the jaw 48, and the spring 94 biases the jaw 48 toward the axial center i.e. against the neck portion 74 of the prong 6.

Figure 5:
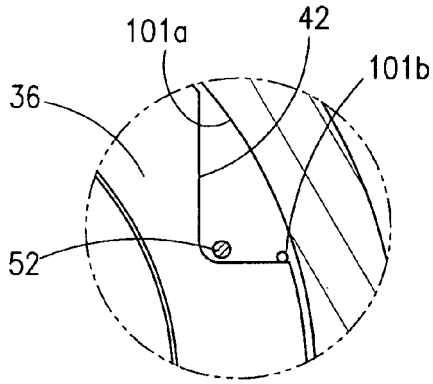
FIG. 5 is an expanded view of the cam surface of the activation disc seen in FIG. 4.
Figure 4:
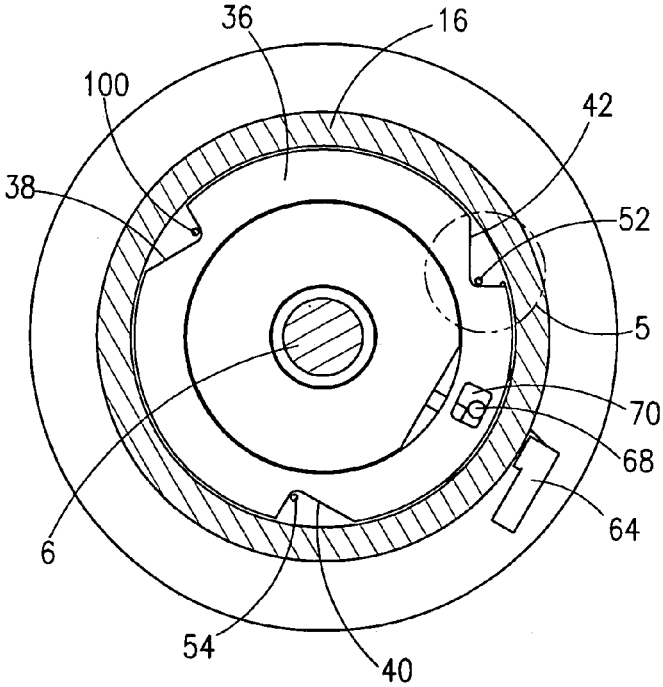
FIG. 4 is a partial cross-sectional view of the activation disc seen in FIG. 3.

In order to disengage the jaws 44, 46, 48 from the neck portion of prong 6, the activation disc 36 will have to be rotated via the projection 68. Referring now to FIG. 4, a partial cross-sectional view of the activation disc 36 seen in FIG. 2 will now be described. More specifically, FIG. 4 shows the top view of the activation disc 36 without the jaws 44, 46, 48. FIG. 4 shows the position of the pin 52 for jaw 44, pin 54 for jaw 48 and pin 100 for jaw 46. Hence, pin 52 is abutting cam surface 42, pin 100 is abutting cam surface 38 and pin 54 is abutting cam surface 40. As seen, the cam surface 38, 40, 42 are curved notches within disc 36. FIG. 5 is an expanded view of the cam surface 42 of the activation disc 36 seen in FIG. 4. As will be more fully set out in the application, as the activation disc 36 is rotated, the sloping cam surface 42 will cause the pin 52 (and in turn the jaw 44) to be drawn towards the inner wall 101*a* thereby opening the jaws. A stop pin 101*b* is shown which stops movement of the activation disc 36 beyond a predetermined point.

Figure 6:
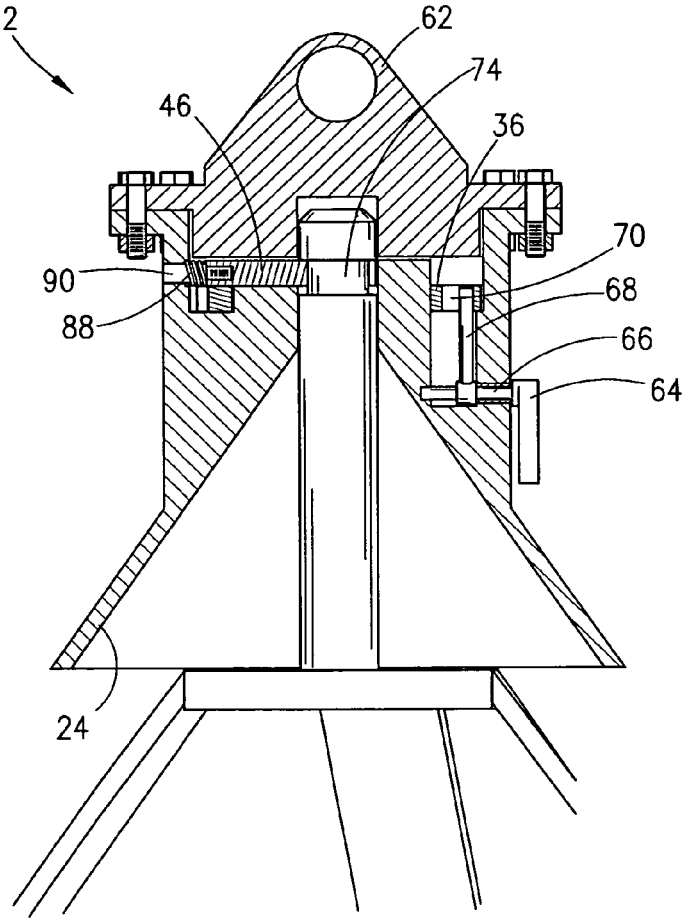
FIG. 6 is a cross-sectional view of the latching mechanism taken along line 7-7 of FIG. 7.

Referring now to FIG. 6, a cross-sectional view of the latching mechanism 2 taken along line 6-6 of FIG. 7 will now be described. This view depicts the jaws engaging the neck portion, and in particular the jaw 46 engaging neck portion 74, and wherein the spring 88 has biased the jaw 46 into engagement. Hence, the prong 6 is engaged. The handle 64 and the radially connected arm 66 is shown, and wherein the projection 68 is shown disposed through the activation disc 36. Note that the indicator pin 90 is not visible in the position shown in FIG. 6 which indicates the jaws engaged position.

Figure 7:
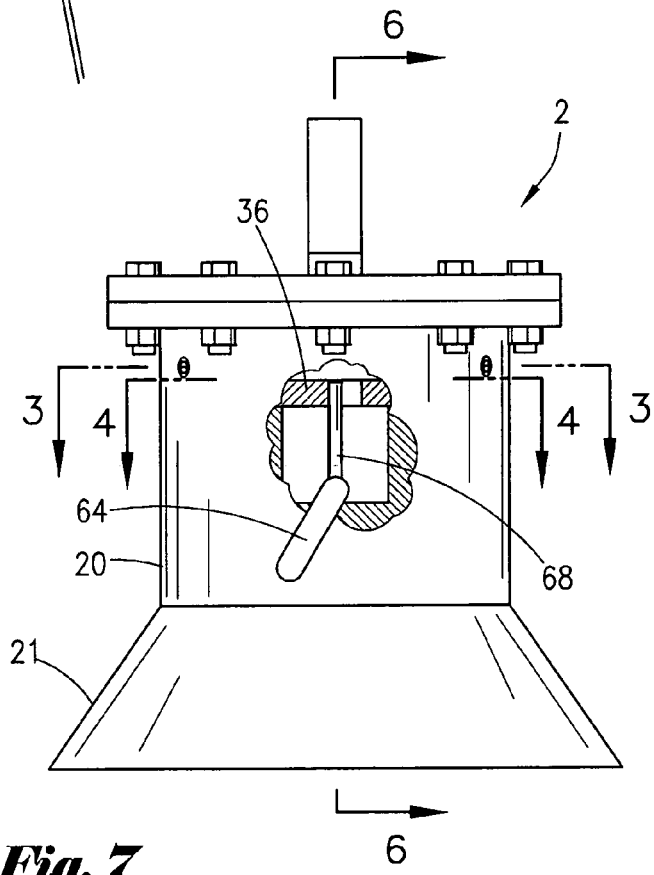
FIG. 7 is a partial cut-away view of the handle means of the latching mechanism corresponding to the jaws being in the contracted position.

A partial cut-away view of the handle 64 of the latching mechanism 2 corresponding to the jaws being in the contracted position is shown in FIG. 7. The partial cut-away within the cylindrical body 20 depicts the projection 68 disposed through the activation disc 36. FIG. 7 further shows the line 3-3 for the partial cross-sectional view of FIG. 3 and line 4-4 for the partial cross-sectional view of FIG. 4.

Figure 8:
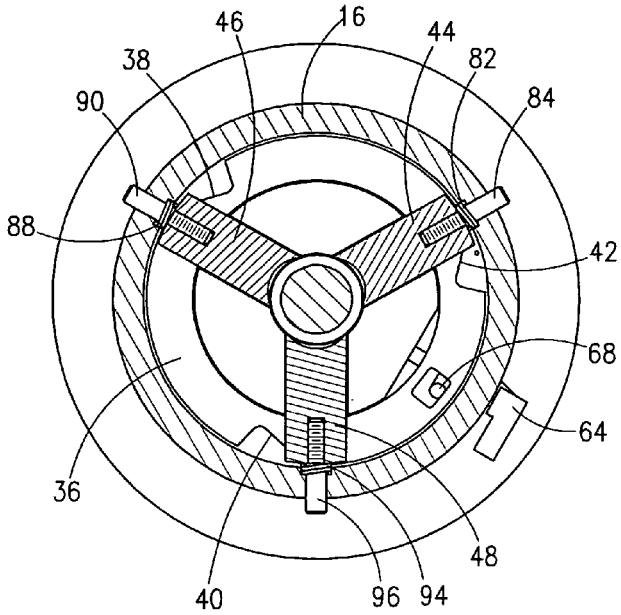
FIG. 8 is a sequential partial cross-sectional view of the jaws and activation disc with the jaws being in the expanded, open position.

Referring now to FIG. 8, a sequential partial cross-sectional view of the jaws 44, 46, 48 and activation disc 36 with the jaws being in the expanded open position will now be described. More specifically, the handle 64 has been rotated which in turn causes the projection 68 to rotate the activation disc 36. The pins 52, 54, 100 (not seen in this view) follow the cam surfaces 38, 40, 42 which in turn cause the jaws 44, 46, 48 to expand (open). As seen in FIG. 8, the springs 82, 88, and 94 are compressed do to this movement.

FIG. 8 additionally depicts the feature of the indicator pins 84, 90, 96 disposed through the apertures. As seen in FIG. 8, the indicator pins 84, 90, 96 serve as indicator means for indicating the position of the jaws. In other words, the visible ends of indicator pins 84, 90, 96 indicate that the jaws are in the open position. In this way, an operator can visually determine the position of the jaws and whether the prong is latched or unlatched. Hence, when the operator sees the indicator pin, the operator can determine that the jaw is not latched with the prong.

Figure 10:
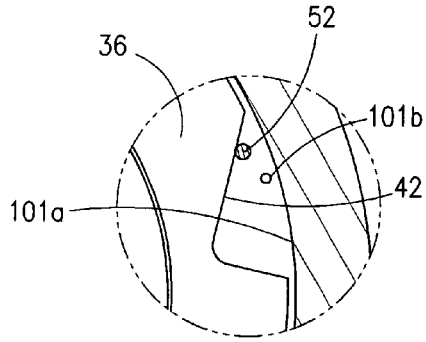
FIG. 10 is an enlarged view of a cam surface seen in FIG. 9.
Figure 9:
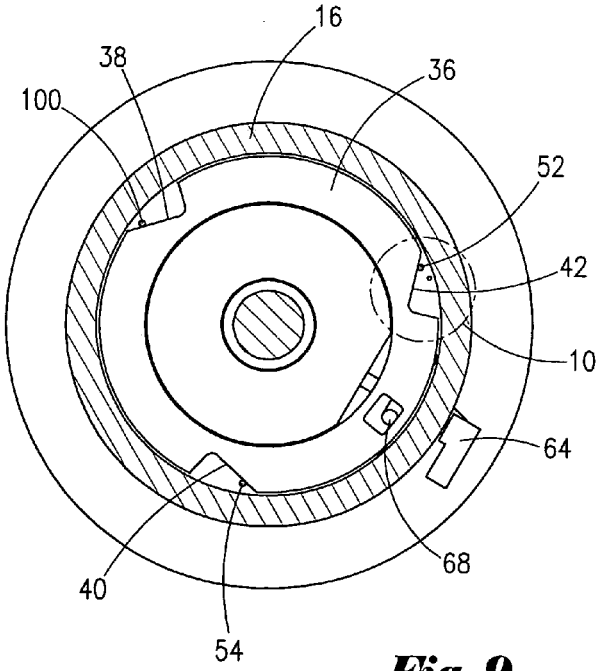
FIG. 9 is a partial cross-sectional view of the actiavation disc seen in FIG. 8.

FIG. 9 is a partial cross-sectional view of the activation disc 36 seen in FIG. 8. FIG. 9 depicts the pins 52, 54, 100 in relation to the cam surfaces 42, 40, 38. FIG. 10 is an enlarged view of a cam surface 42 seen in FIG. 9 engaging the pin 52. As seen in FIG. 10, the movement of the cam surface 42 has caused the pin 52 (and in turn jaw 44) to move towards inner wall 101*a*.

Figure 11:
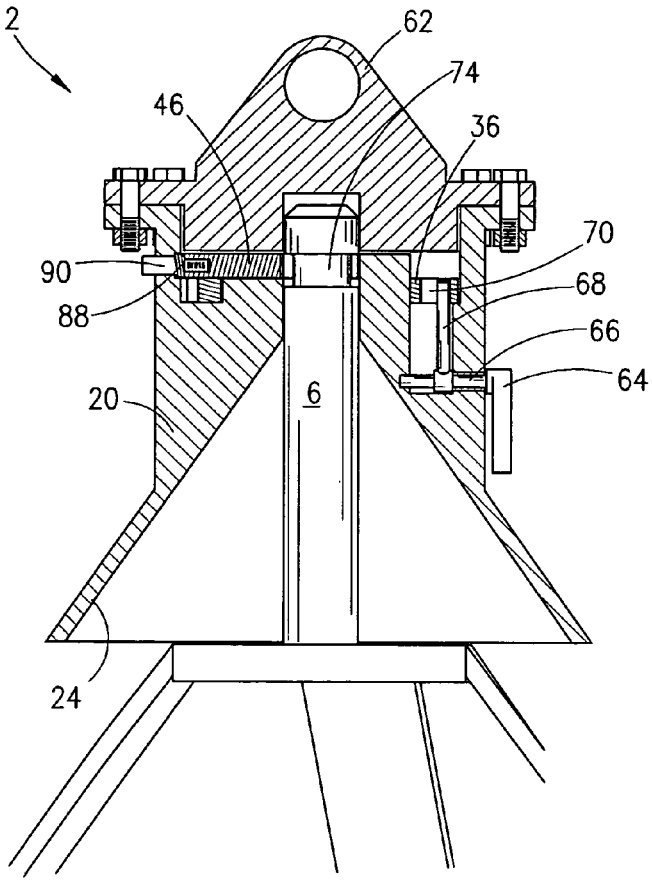
FIG. 11 is a cross-sectional view of the latching mechanism seen in FIG. 6 with the jaws in the expanded, open position.

Referring now to FIG. 11, a cross-sectional view of the latching mechanism 2 seen in FIG. 6 with the jaws in the expanded (open) position. Hence, the projection 68 has caused the rotation of the activation disc 36, which in turn caused the jaw to expand thereby contracting the spring 88. As seen in FIG. 11, jaw 46 is no longer engaging the neck portion 74. Also, the indicator pin 90 is extending outward from the body 20 indicating an open jaw.

Figure 12:
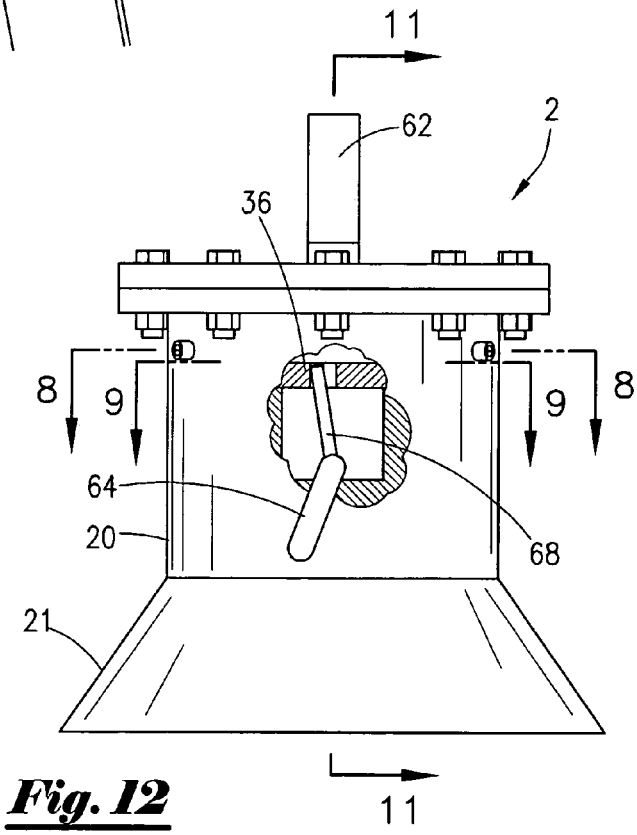
FIG. 12 is a partial cross-sectional view of the handle means of the latching mechanism corresponding to the jaws being in the expanded position.

FIG. 12 is a partial cut-away view of the handle 64 of the latching mechanism 2 corresponding to the jaws being in the expanded position. The projection 68 is shown disposed through the activation disc 36. It should also be noted that the handle may be manually, hydraulically and/or pneumatically controlled. Also, it is within the teachings of this invention that actuation of the handle 64 can be done remotely i.e. remote control of the handle in order to turn the handle. FIG. 12 also shows the line 8-8 for the partial cross-sectional view of FIG. 8, the line 9-9 for the partial cross-sectional view of FIG. 9, and the line 11-11 for the partial cross-sectional view of FIG. 11.

Figure 13:
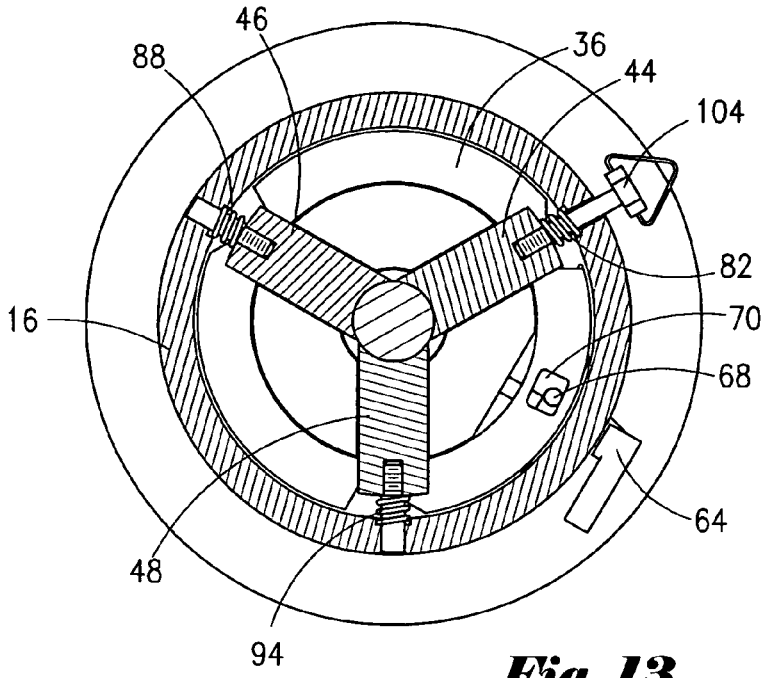
FIG. 13 is a partial cross-sectional view of the jaws and activation disc, with the jaws about the prong, and depicting the jaw insertion device.
Figure 14:
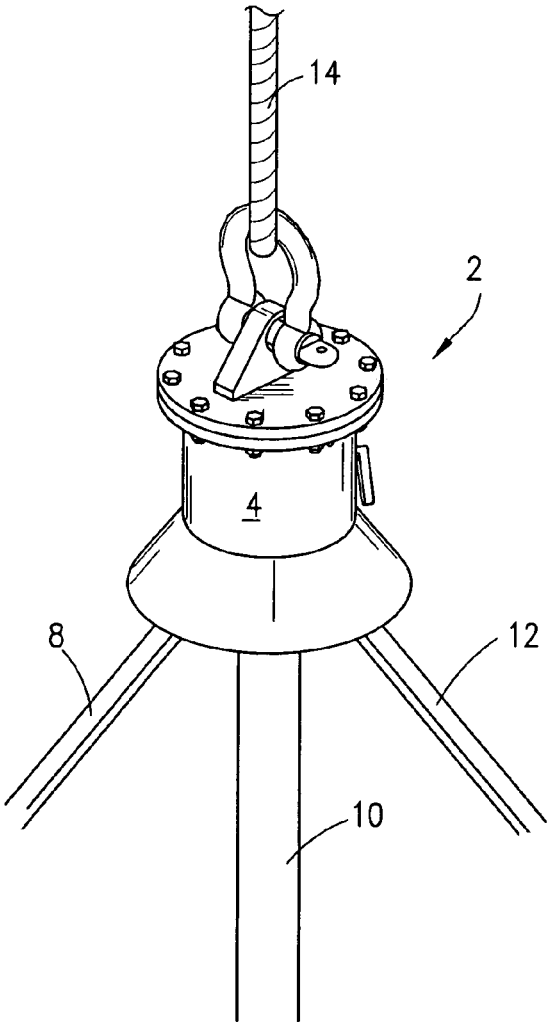
FIG. 14 is a perspective view of the latching mechanism and the receiving receptacle latched together.

FIG. 13 depicts a partial cross-sectional view of the jaws 44, 46, 48 and activation disc 36, with the jaws about the prong, and depicting the jaw insertion device. FIG. 14 is a perspective view of the latching mechanism and the receiving receptacle latched together.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A latching mechanism for lifting and lowering loads comprising:

a prong having a protuberance at a first end;

a receiving receptacle configured to receive said first end of said prong, said receiving receptacle comprising:

a body having a central passage;

a plurality of jaws arranged about said central passage, each of said jaws having a pin extending therefrom;

biasing means for biasing said jaws to extend into said central passage and engaging said protuberance, said biasing means comprising a plurality of springs, each of said springs having a first end engaging one of said jaws and a second end engaging an internal portion of said body so that said jaw is biased into said central passage; and an activation disc for disengaging said jaws from said protuberance, said activation disc containing a plurality of cam surfaces, each of said cam surfaces engages one of said pins of said jaws.

2. The latching mechanism of claim 1 wherein said body comprises a first section that is attached to a second section, and wherein said second section contains said plurality of jaws and said activation disc, and wherein said first section is configured to abut and align said plurality of jaws and activation disc.

3. The latching mechanism of claim 1 wherein said receiving receptacle further comprises:

a handle mounted through said body so that said handle has an exterior portion and an internal portion, said handle having a projection on said internal portion that engages said activation disc so that movement of handle creates movement of said activation disc.

4. The latching mechanism of claim 3 wherein said receiving receptacle further comprises:

a funnel attached to said body, said funnel having a conical shape, and wherein said funnel is configured to direct said prong into said central passage.

5. A latching mechanism for lifting and lowering loads comprising:

a prong having a protuberance at a first end, and wherein said protuberance extends to a neck of reduced diameter;

a receiving receptacle configured to receive said first end of said prong, said receiving receptacle comprising:

a cylindrical body having an axial passage;

jaw means for engaging and disengaging said protuberance arranged about said central passage, said jaw means comprising a plurality of jaw inserts having a first curved end to engage said neck of said prong;

a pin extending from each of said jaw inserts;

biasing means for biasing said jaws means to extend into said axial passage and engage said protuberance, said biasing means comprising a plurality of springs, each of said springs having a first end engaging one of said jaw inserts and a second end engaging an internal portion of said body so that said jaw insert is biased towards said axial passage;

an activation disc for disengaging said jaw means from said protuberance, said activation disc including a plurality of cam surfaces formed thereon, each of said cam surfaces engages one of said pins so that rotational movement of said activation disc creates lateral movement of said pin; and means for attaching a cable to said receiving receptacle.

6. The latching mechanism of claim 5 wherein said body comprises a first section that is attached to a second section, and wherein said second section contains said jaw inserts and said activation disc, and wherein said first section is configured to abut and align a top side of said jaw inserts and said activation disc.

7. The latching mechanism of claim 5 wherein said receiving receptacle further comprises:

a handle mounted through said body so that said handle has an exterior portion and an internal portion, said handle having a projection that engages said activation disc so that movement of said handle creates the rotational movement of said activation disc.

8. The latching mechanism of claim 7 wherein said receiving receptacle further comprises:

an alignment skirt attached to said body, said alignment skirt having a conical shape, and wherein said alignment skirt is configured to direct said prong into said axial passage.

9. The latching mechanism of claim 5 wherein each of said springs is disposed about an indicator pin, and wherein said indicator pin extends through an aperture in said body when said jaw inserts are disengaged from said protuberance.

10. The latching mechanism of claim 5 further comprising a jaw insertion device for engaging said jaw inserts from an aperture within said body so that said jaw inserts can be subjected to a pull force by said jaw insert device.

* * * * *